US006189496B1

(12) United States Patent
Heffner et al.

(10) Patent No.: US 6,189,496 B1
(45) Date of Patent: Feb. 20, 2001

(54) BREATHER VALVE, ARRANGEMENT AND METHOD

(75) Inventors: Daniel J. Heffner, Muscoda; Scott A. Sjovall, Westby, both of WI (US)

(73) Assignee: S & S Cycle, Inc., Viola, WI (US)

( * ) Notice: Under 35 U.S.C. 154(b), the term of this patent shall be extended for 0 days.

(21) Appl. No.: 09/479,100

(22) Filed: Jan. 7, 2000

(51) Int. Cl.[7] ..... F02B 33/04
(52) U.S. Cl. ..... 123/73 AD; 123/196 CP
(58) Field of Search ..... 123/73 AD, 196 CP, 123/196 R

(56) References Cited

U.S. PATENT DOCUMENTS 2,111,242 * 3/1938 Harley ..... 123/196 CP
4,142,487 * 3/1979 Somraty ..... 123/196 CP
4,532,897 * 6/1985 Mezger ..... 123/196 R
4,765,291 * 8/1988 Kurio et al. ..... 123/73 AD
4,869,213 9/1989 Panzica .

OTHER PUBLICATIONS

RevTech® Adjustable Breather Valves, Crankcase Breathers, *Engine*, p. 10, undated catalog.
Declaration of Scott A. Sjovall, including Exhibits A–F.

* cited by examiner

*Primary Examiner*—Marguerite McMahon
(74) *Attorney, Agent, or Firm*—Merchant & Gould P.C.

(57) ABSTRACT

A breather valve and arrangement for an internal combustion engine, having a scavenge hole that is open for a relatively long period of time relative to piston travel. Scavenge hole preferably subtends an angle of between 20° and 150°, and preferably is open from between 30° and 135° of piston travel. A method of replacing an existing breather valve with this novel breather valve is also described. Other arrangements for achieving the advantages of the novel breather valve are also described.

11 Claims, 5 Drawing Sheets

20
16
10
11
A/O
β
12
14
22

10
18
α

BREATHER VALVE, ARRANGEMENT AND METHOD

FIELD OF THE INVENTION

This invention relates generally to breather valves used in internal combustion engines, and more particularly to an improved breather valve and breather valve arrangement intended for motorcycle engines, and to a method of replacing the breather valve in such engines with the improved breather valve.

BACKGROUND OF THE INVENTION

Rotary breather valves for motorcycle engines have been used for many years. The purpose of a breather valve is generally twofold. First, it expels air and oil from the crank case, on the down stroke of the pistons, to the gear case where the oil lubricates various gears and other parts. Second, it draws oil from the bottom of the oil separating pocket (also sometimes referred to as the "settling pocket") in the bottom of the gear case.

Regarding the second purpose, problems arise when the engine is modified to have a larger displacement. The higher horsepower engine results in, among other things, more oil being expelled from the crank case into the gear case (and ultimately the gear case oil separating pocket). If not removed ("scavenged") by the breather valve, this excess oil will leave the engine through the air cleaner system, which is referred to as oil carryover (sometimes also referred to as "blowby" or "puking"). Oil carryover contaminates the air filter and thereby reduces its effectiveness, undesirably enriches the fuel coming into the engine, and pollutes the environment. Excess oil in the gear case can also reduce horsepower.

It can be seen that a new breather valve is needed that improves the scavenging of oil from the oil separating pocket of the gear case.

SUMMARY OF THE INVENTION

The present invention can be practiced in a number of ways, including by replacing an existing breather valve with one for example like that described herein, by modifying the breather valve cavity (into which the breather valve is inserted) in an existing engine, or by constructing either or both the breather valve and the engine cavity, in an existing or new engine, so that the advantages of the present invention are obtained.

In one aspect of the apparatus of the present invention, a breather valve comprises a gear proximate a first end for engagement with a corresponding gear in the engine, and a generally cylindrical body fixed to and extending from the gear. The cylindrical body has an open end opposite the gear for drawing oil and air from the engine crank case into a breather valve interior. A first arcuate port in the cylindrical body is for registration with a corresponding opening in the engine to draw oil and air from the breather valve interior into the engine gear case. The first arcuate port extends substantially across the middle portion of the cylindrical body and subtends an angle between 70° and 270°. A second arcuate port in a cylindrical body is for registration with a second corresponding opening in the engine to draw oil from the gear case oil separating pocket into the breather valve interior. The second arcuate port is positioned between the first arcuate port and a second end of the breather valve, has a center offset circumferentially from the center of the first arcuate port, and subtends an angle between 20° and 150°.

In another aspect of the apparatus of the present invention, a breather valve arrangement comprises a breather valve including a gear engaging a corresponding gear in the engine, a cylindrical body having an open end opposite the gear, and a port formed in the body for drawing oil from the gear case oil separating pocket into a breather valve interior. Structure in the engine around the breather valve defines an opening for registration with the breather valve port. The breather valve and engine structure are constructed and arranged, and the breather valve port and corresponding opening are configured and sized, such that the port and corresponding opening are in at least partial registration for a total of between 30° and 135° of piston travel.

In one aspect of the method of the present invention, a method of improving the removal of oil from the gear case oil separating pocket comprises removing a first breather valve from the engine having a scavenge opening that subtends an angle of less than 20°, providing a second breather valve having a scavenge opening that subtends an angle of between 20° and 150°, and installing the second breather valve into the engine so that the second scavenge opening draws oil from the separating pocket for a longer period of time.

These and other advantages and features of novelty which characterize the invention are pointed out with particularly in the claims annexed hereto. However, for a better understanding of the invention and its advantages, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference numerals and letters refer to corresponding parts throughout the various figures.

DETAILED DESCRIPTION OF THE PREFERRED EMBODIMENT

Figure 1:
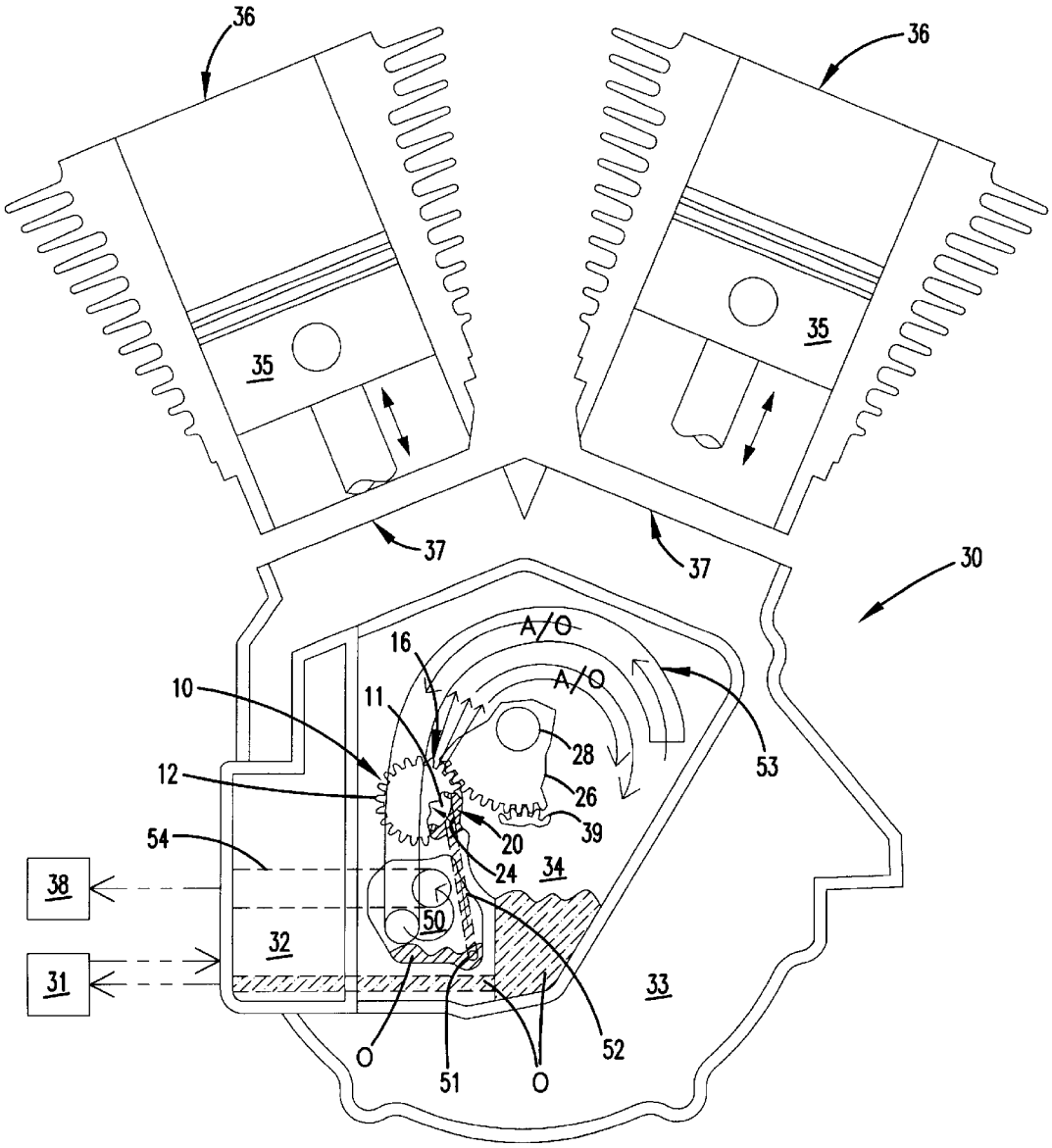
FIG. 1 is a diagrammatic view of a motorcycle engine depicting the breather valve operation.
Figure 2:
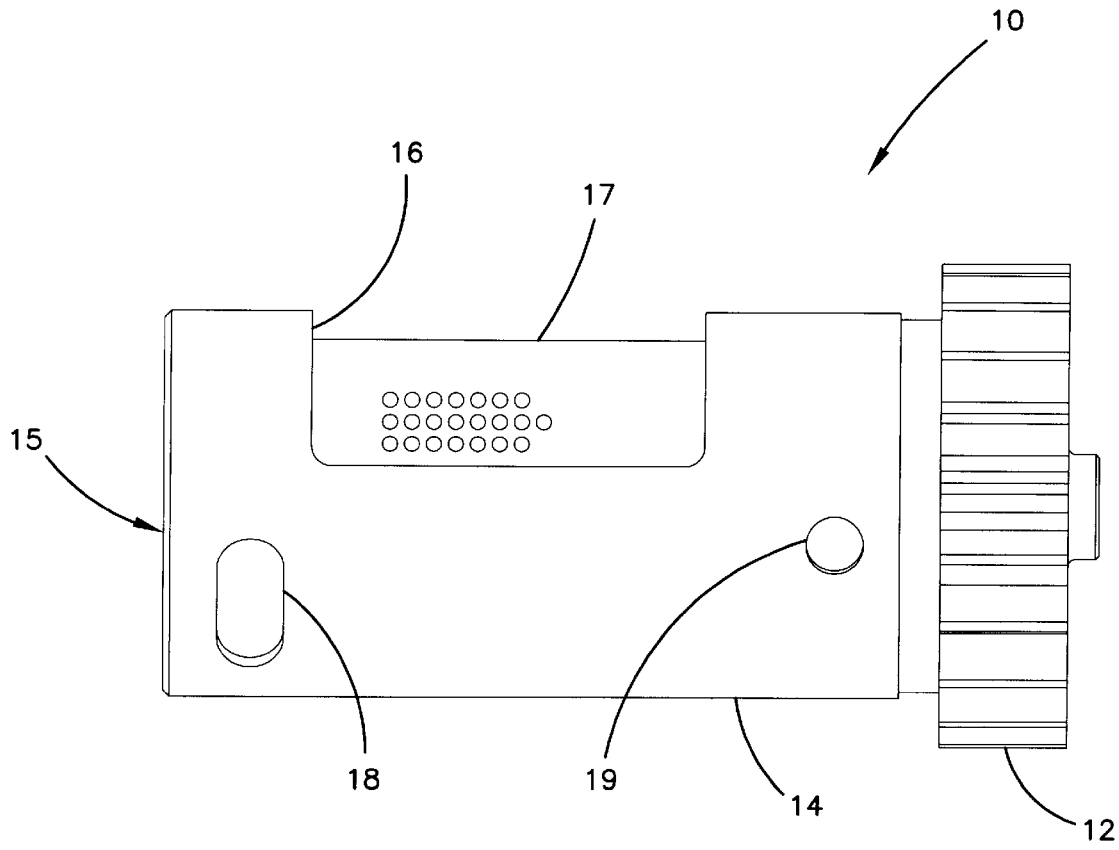
FIG. 2 is a plan view of a breather valve according to the present invention.
Figure 3:
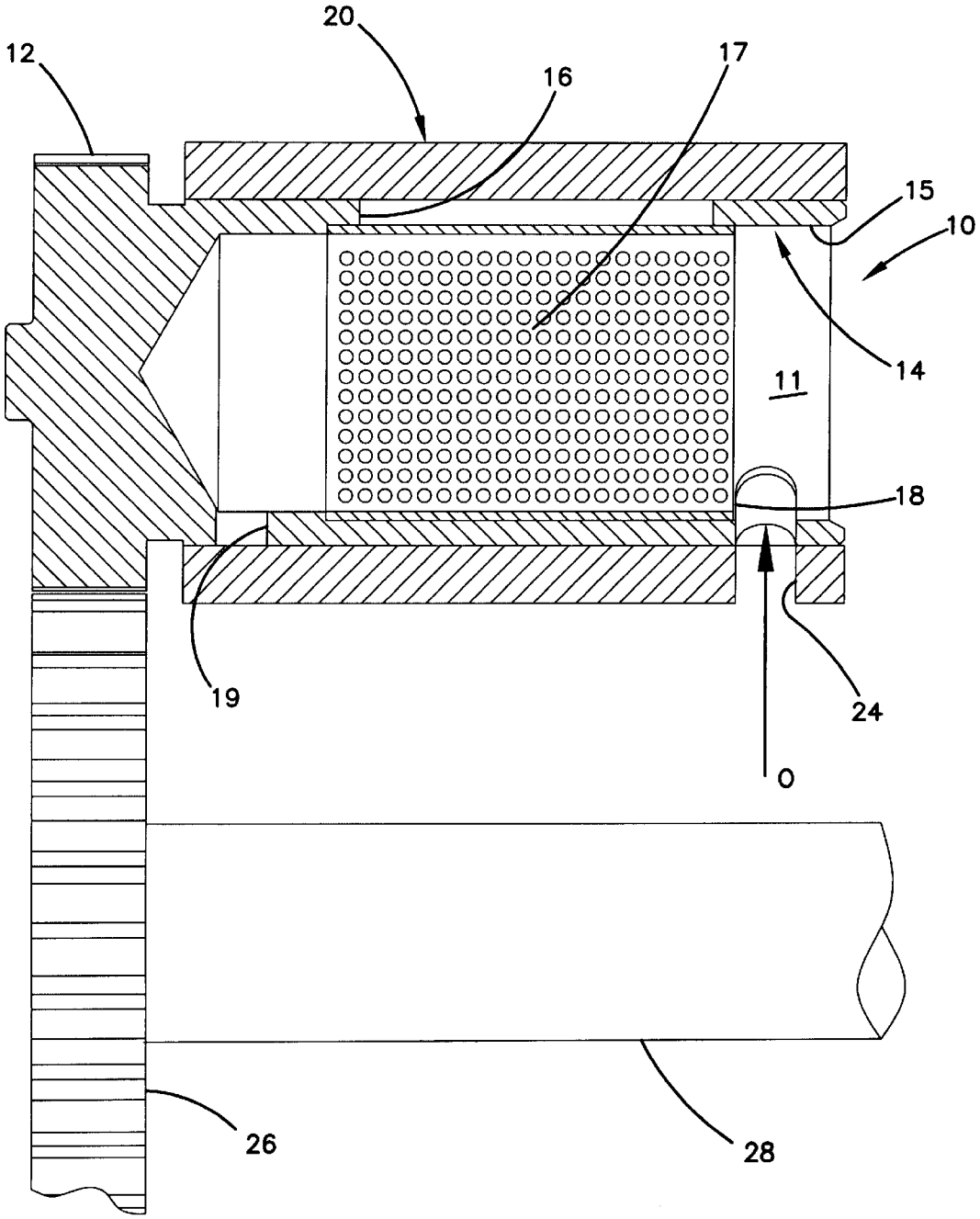
FIG. 3 is a cross-sectional view of the breather valve of FIG. 2, shown in the breather cavity and in engagement with the driving gear.

Referring to FIGS. 1 and 3, rotary breather valve 10 is shown installed in a motorcycle engine 30 within crank case 33 and gear case 34. FIG. 1 diagramatically depicts the operation of breather valve 10 and the relevant flow of oil and air through the engine. Oil pump 32 pumps oil from oil tank 31 into different areas of the engine, including to pistons 35. Most of that oil drains through gravity into the crank case cavity 33. Some of the oil O drains into the gear case cavity 34, as shown. Oil pump 32 draws the oil O from there and returns it to oil tank 31.

Gear case 34 normally contains a mixture of air and oil. Much of that mixture A/O travels through a passage 53 in the gear case cover and into oil separating chamber 50. From there, the oil O is removed from chamber 50 by breather valve 10 as will be discussed below, and the air is removed through passage 54 to air cleaner 38. As discussed above, if breather valve 10 does not sufficiently remove oil from separating chamber 50, this results in many adverse consequences.

Breather valve 10 rotates in timed relation to piston travel. Crank shaft pinion gear 39 engages and rotates cam gear 26 (and shaft 28) which in turn engages and rotates gear 12 of breather valve 10.

Breather valve 10 includes gear 12, cylindrical body or drum 14 and screen 17. While gear 12 and cylindrical body 14 are formed as a single part in the preferred embodiment, as shown in FIG. 3, they could be two or more separate parts connected together within the principles of the invention. Two openings are formed in cylindrical body 14, window 16 and scavenge hole 18, that perform different functions (second hole 19 shown in the drawings will not be discussed herein because it is not relevant to the invention and typically serves no function).

Figure 4:
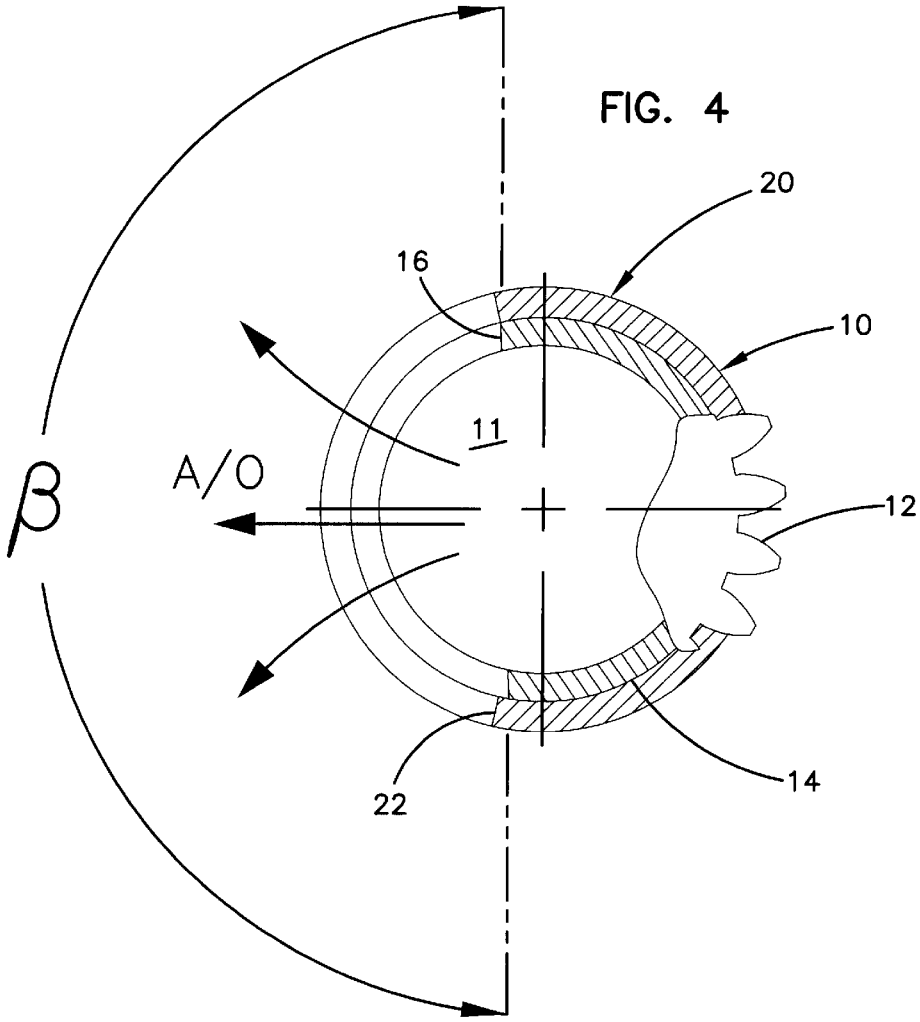
FIG. 4 is a cross-sectional view of the breather valve of FIG. 2 and the breather cavity, showing registration between the breather valve window and the corresponding opening in the engine.

Window 16 moves oil and air from crank case cavity 33 to gear case cavity 34. As air pressure builds up in crank case cavity 33 upon downstroke of pistons 35 (moving from top dead center ("TDC") 36 to bottom dead center ("BDC") 37), air and oil A/O travels into breather valve interior 11 through open end 15 and then out window 16, as depicted in FIGS. 1 and 4. Metal screen 17, commonly used in breather valves, stops debris like metal particles from entering gear case 34, and turns the oil droplets into a fine mist to better coat the parts in gear case 34. Window 16 is at this time registering with corresponding window 22 in breather cavity 20, as shown in FIG. 4, in timed relation to piston travel. In the preferred embodiment, window 16 begins to open at 17° after TDC and is fully closed at 82° after BDC (relative to front piston travel). Window 16 preferably subtends an angle $\beta$ of approximately 170°, although a sweep anywhere between 70° and 270° could be acceptable. Window 16 is shaped as an arcuate port formed in cylindrical body 14 and extends substantially across the middle portion of cylindrical body 14.

Figure 6:
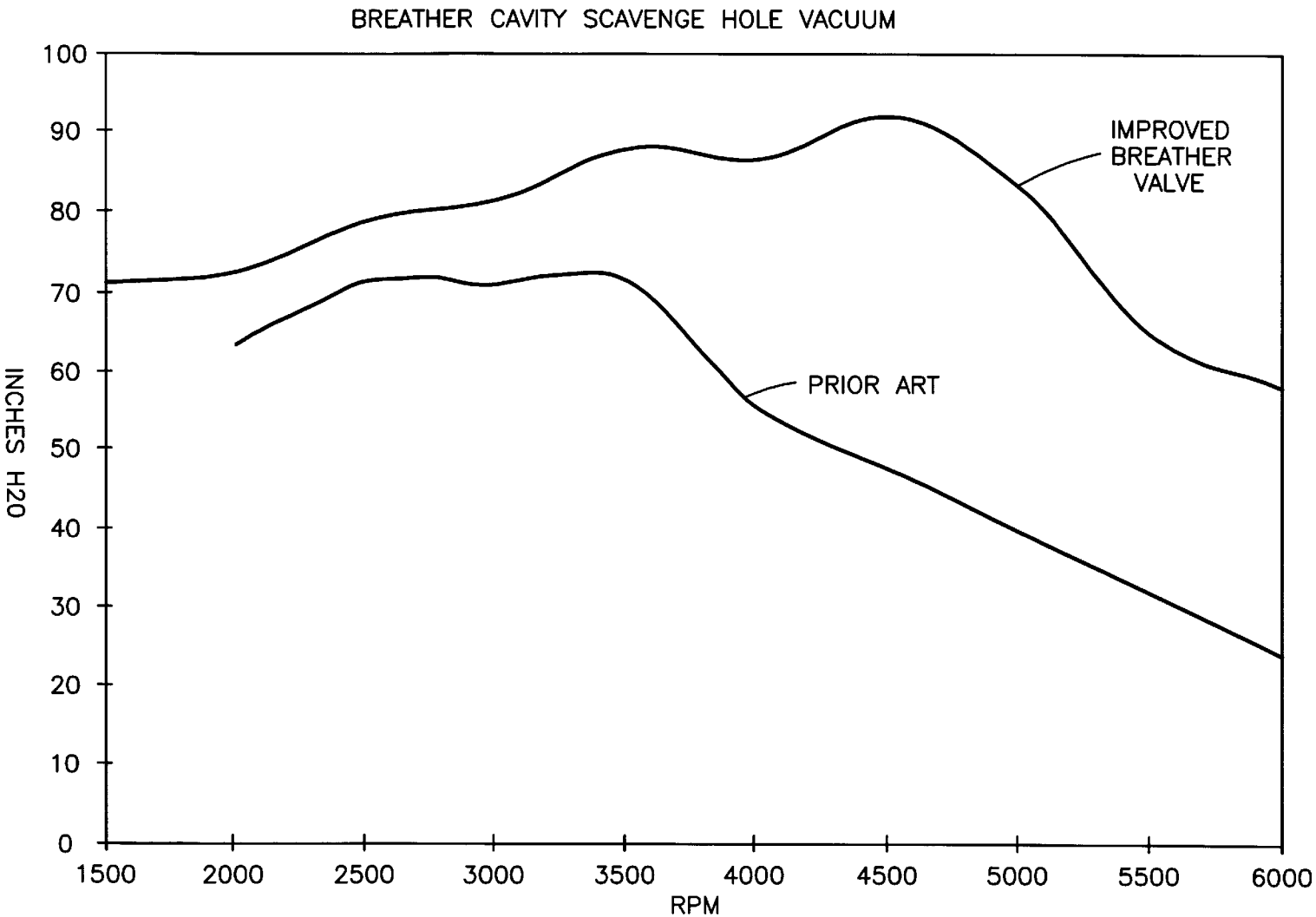
FIG. 6 is a graph of breather cavity scavenge hole vacuum, comparing an improved breather valve according to the present invention with a prior art breather valve.

Scavenge hole 18 is for the purpose of removing oil from separating pocket 51 of oil separating chamber 50 in gear case 34. Prior art breather valves, such as that shown and described in U.S. Pat. No. 4,869,213, have a small circular scavenge hole that does not draw enough oil out of the gear case for larger displacement engines. The stock Harley-Davidson® breather valve that has been in use for many years has only a diameter of about 0.17 inches, subtends an angle of about 16°, and is only open for 29° of piston travel, typically open at 64° before TDC and closed at 35° before TDC. The much larger elongated scavenge hole 18 of the preferred breather valve 10 results in a much stronger vacuum draw than the prior art stock breather valve, as shown in FIG. 6, showing an improvement in testing of over 50% on average and as high as about 100% on the high end of the RPM range.

Scavenge hole 18 functions as follows. As pistons 35 travel from BDC to TDC, and with window 16 closed at that time, vacuum builds up in crank case cavity 33 and therefore in breather valve interior 11 via open end 15. Preferably near maximum vacuum, scavenge hole 18 begins to open by engagement with corresponding circular hole 24 in breather cavity 20, as shown in FIGS. 1 and 3. Referring to FIG. 1, the vacuum in valve interior 11 then draws oil O from separating pocket 51, through passage 52, corresponding hole 24 and scavenge hole 18, and into interior 11. Upon the next opening of window 16, that oil is then expelled, along with air and oil from crank case 33, into gear case cavity 34, as discussed above.

Figure 5:
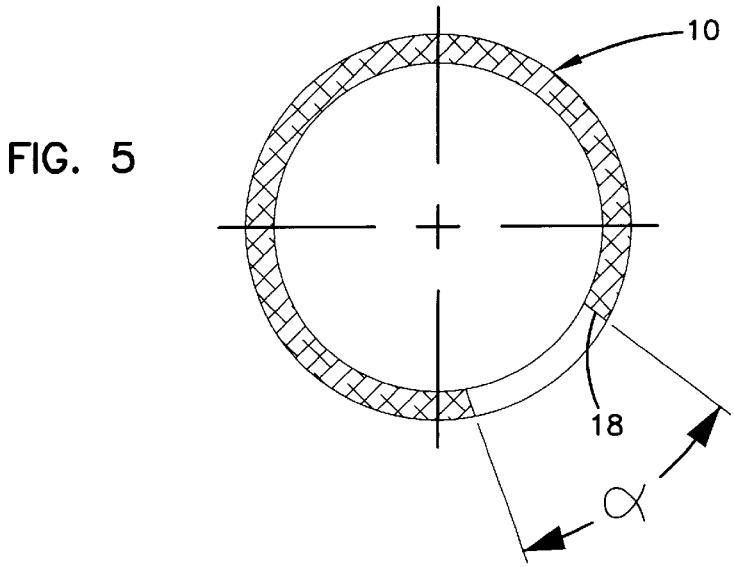
FIG. 5 is a cross-sectional view of the breather valve of FIG. 2, taken through the scavenge hole.

In the preferred breather valve 10, scavenge hole 18 is an arcuate port that is shaped obround, with straight sides and semicircular ends. It is 0.48 inches long, 0.17 inches wide, subtends an angle $\alpha$ of 49° 51' (as shown in FIG. 5), and the radii of curvature of its ends is 0.085 inches. Scavenge hole 18 preferably begins to open at 45° before TDC and is fully closed at 20° after TDC, for a total piston travel of 65°. The center of scavenge hole 18 is offset from the center of window 16 by 126° on cylindrical body 14.

It will be understood that many of these parameters can be varied fairly significantly within the principles of the invention. For example, scavenge hole 18 could subtend an angle anywhere from 20° to 150° and obtain advantages relative to the prior art. Similarly, advantages would be obtained if the amount of time scavenge hole 18 is open is anywhere between 30° and 135° of total piston travel.

It will also be understood that a variety of breather valve/breather cavity configurations could achieve the advantages herein within the principles of the invention. For example, corresponding hole 24 could be made larger instead of scavenge hole 18, or both could be made larger, in order to achieve a longer duration of scavenge hole open time and therefore higher vacuum and better oil scavenging from the separating pocket.

It is to be under that, even though numerous specific characteristics and advantages of the present invention have been set forth in the foregoing description, together with details of the structure and function of the invention, this disclosure is illustrative only, and changes may be made in detail, especially in matters of shape, size, and arrangement of parts, within the principles of the invention to the full extent indicated by the broad general meanings of the terms in which the appended claims are expressed.

What is claimed is:

1. A method of improving the removal of oil from the gear case oil separating pocket of an internal combustion engine, the method comprising:

removing a first breather valve from the engine having a first scavenge opening that subtends an angle of less than 20°;

providing a second breather valve having a second scavenge opening that subtends an angle of between 20° and 150°; and installing said second breather valve into the engine, including timing said valve relative to piston travel so that said second scavenge opening is in at least partial registration with a corresponding opening in the engine from at least 30° before TDC to at least 5° after TDC.

2. A method according to claim 1, wherein said second scavenge opening subtends an angle of approximately 50°.

3. A method according to claim 1, wherein said second scavenge opening is generally obround in shape and is approximately 0.5 inches long.

4. A method according to claim 1, wherein said at least partial registration is for a total of about 65° of piston travel. preceding "before TDC".

5. A method according to claim 1, wherein said at least partial registration is from between 55° and 35° before TDC to between 10° and 30° after TDC.

6. A breather valve arrangement in an internal combustion engine, comprising:

a breather valve including a gear engaging a corresponding gear in the engine, a generally cylindrical body having an open end opposite said gear, and a port formed in said body for drawing oil from the gear case oil separating pocket into a breather valve interior;

structure in the engine around said breather valve and defining an opening for registration with said breather valve port;

said breather valve and engine structure constructed and arranged, and said breather valve port and corresponding opening configured and sized, such that said port and corresponding opening are in at least partial registration from at least 30° before TDC to at least 5° after TDC.

7. A breather valve arrangement according to claim 6, wherein said breather valve, port, engine structure and corresponding opening are constructed and arranged such that said port and corresponding opening are in at least partial registration for a total of approximately 65° of piston travel.

8. A breather valve arrangement according to claim 7, wherein said breather valve port begins registration with said corresponding opening at between 55° to 35° before TDC and terminates registration at between 10° and 30° after TDC.

9. A breather valve arrangement according to claim 6, wherein said breather valve port is arcuate and subtends an angle, relative to said cylindrical body, of between 20° and 80°.

10. A breather valve arrangement according to claim 9, wherein said breather valve port is approximately 0.5 inches long.

11. A breather valve arrangement according to claim 6, wherein said corresponding opening has a diameter of approximately 0.17 inches.

* * * * *